US010869120B1

(12) United States Patent
Jacobs et al.

(10) Patent No.: US 10,869,120 B1
(45) Date of Patent: Dec. 15, 2020

(54) HEADSET DIPOLE AUDIO ASSEMBLY

(71) Applicant: Facebook Technologies, LLC, Menlo Park, CA (US)

(72) Inventors: Joel Bernard Jacobs, Seattle, WA (US); Clare Regimbal Long, Edmonds, WA (US); Simon Porter, San Jose, CA (US); Joseph Patrick Sullivan, Seattle, WA (US); Peter Allan Chase Newbury, Burlington, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 16/737,316

(22) Filed: Jan. 8, 2020

(51) Int. Cl.
*H04R 1/34* (2006.01)
*H04R 1/10* (2006.01)

(52) U.S. Cl.
CPC ..... *H04R 1/345* (2013.01); *H04R 1/105* (2013.01); *H04R 1/1008* (2013.01); *H04R 1/1075* (2013.01); *H04R 2400/11* (2013.01); *H04R 2460/11* (2013.01)

(58) Field of Classification Search
None
See application file for complete search history.

(56) References Cited

U.S. PATENT DOCUMENTS

2015/0237437 A1* 8/2015 Hu ..... H04R 1/2857 381/338
2015/0382100 A1* 12/2015 Azmi ..... H04R 1/2811 381/380
2018/0167710 A1* 6/2018 Silver ..... H04R 1/1075
2018/0242070 A1* 8/2018 Slater ..... H04R 1/1041
2020/0053456 A1* 2/2020 Williams ..... H04R 1/1008

* cited by examiner

*Primary Examiner* — Paul W Huber
(74) *Attorney, Agent, or Firm* — Fenwick & West LLP

(57) ABSTRACT

An audio assembly provides audio content to a user. The audio assembly comprises an elongated body, a negative vent assembly, and a positive vent assembly. The elongated body includes an audio waveguide. The negative vent assembly is coupled to the elongated body and includes at least one negative vent that vents negative acoustic pressure waves generated by a back surface of a transducer coupled to a first end of the audio waveguide. The positive vent assembly is part of the elongated body and is coupled to a second end of the audio waveguide. The positive vent assembly includes at least one positive vent that vents positive acoustic pressure waves generated by a front surface of the transducer.

20 Claims, 11 Drawing Sheets

610

HEADSET DIPOLE AUDIO ASSEMBLY

FIELD OF THE INVENTION

This present disclosure generally relates to audio assemblies used in headsets, and specifically headset dipole audio assemblies.

BACKGROUND

Headsets (e.g., in an artificial reality system) often include audio assemblies configured to provide audio to a user. Some conventional audio assemblies implement monopole speakers where acoustic pressure waves propagate from a single surface towards an ear of the user. One disadvantage of using monopole speakers includes inefficiency of power usage as typical monopole speakers contain an enclosure with a fixed volume of air that increases the amount of work needed to drive the monopole speaker.

SUMMARY

The present disclosure relates to an audio assembly coupled to a headset that provides audio content to a user. The audio assembly comprises an elongated body, a transducer, a negative vent assembly, and a positive vent assembly. The elongated body includes an audio waveguide with a first end and a second end opposite the first end. The transducer is coupled to the first end of the audio waveguide. The negative vent assembly is coupled to a back side of the transducer and includes at least one negative vent that vents negative acoustic pressure waves generated by a back surface of the transducer. The positive vent assembly is part of the elongated body and is coupled to a second end of the audio waveguide. The positive vent assembly includes at least one positive vent that vents positive acoustic pressure waves generated by a front surface of the transducer. The vented acoustic pressure waves may be detected by an ear of the user. The audio content may be complemented by other content provided by the headset, e.g., artificial reality content, visual content, haptic feedback content, etc.

Figure 1:
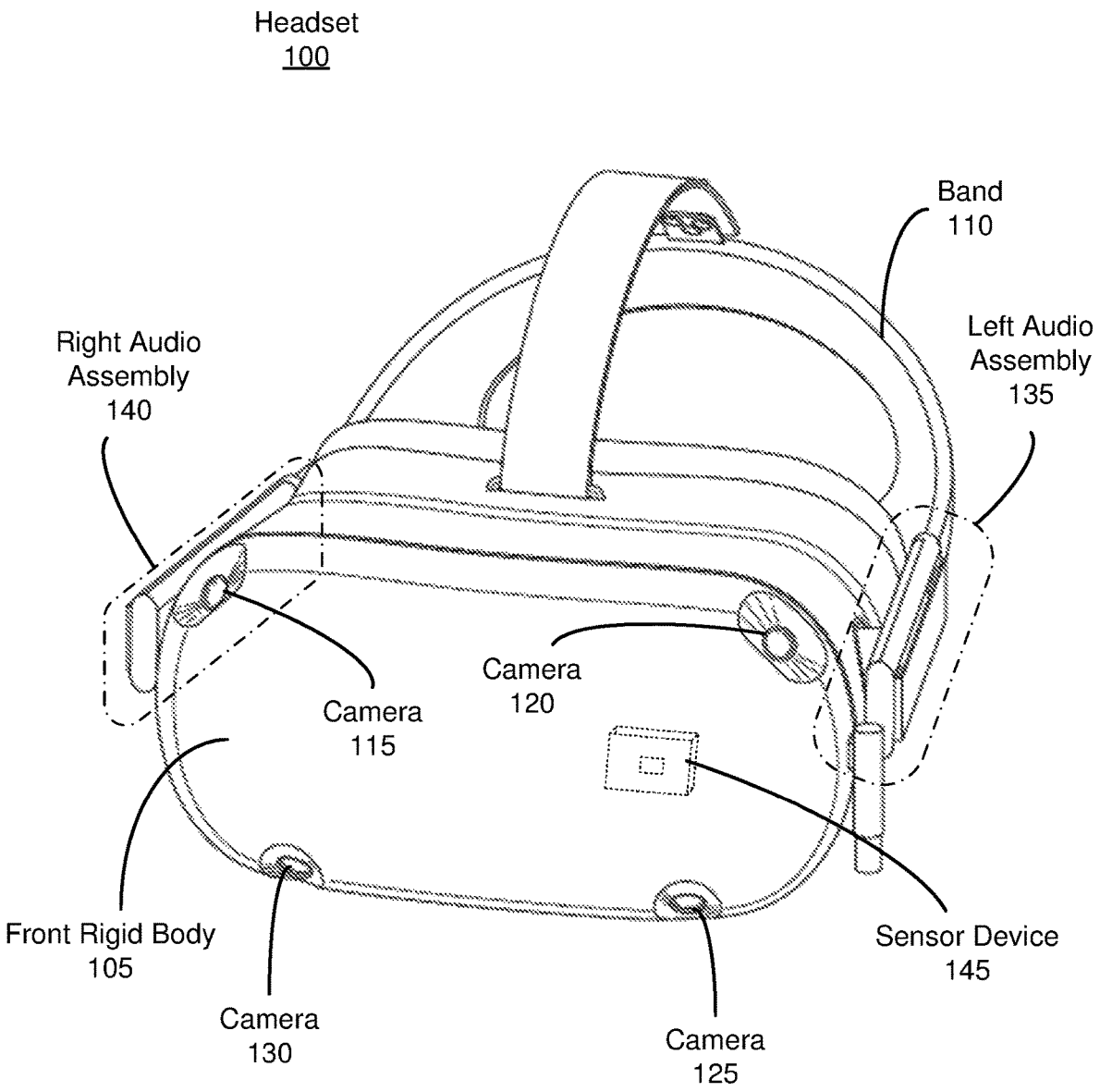
FIG. 1 is a perspective view of a headset, in accordance with one or more embodiments.

The figures depict embodiments of the present disclosure for purposes of illustration only. One skilled in the art will readily recognize from the following description that alternative embodiments of the structures and methods illustrated herein may be employed without departing from the principles, or benefits touted, of the disclosure described herein.

DETAILED DESCRIPTION

Overview

A headset is configured to provide audio content to a user of the headset. The headset incorporates one or more audio assemblies that each generate acoustic pressure waves received by one or more of the user's ears as audio content. Each audio assembly is configured as a dipole audio assembly that utilizes both a positive acoustic pressure wave and a negative acoustic pressure wave to create the audio content. When a transducer's diaphragm displaces forward, a high pressure zone is created in front of the diaphragm generating a positive acoustic pressure wave from the front surface of the diaphragm and a low pressure zone is created behind the diaphragm generating a negative acoustic pressure wave from the back surface of the diaphragm. Each audio assembly comprises an elongated body including an audio waveguide to direct positive acoustic pressure waves to an ear of the user, a negative vent assembly to vent the negative acoustic pressure waves, and a positive vent assembly to vent the positive acoustic pressure waves to the user's ear. The negative vent assembly comprises one or more negative vents that vent the negative acoustic pressure waves generated by a back surface of the transducer. The positive vent assembly comprises at least one positive vent coupled to a second end of the audio waveguide that vents the positive acoustic pressure waves generated from a front surface of the transducer towards a user's ear for providing the audio content to the user.

The audio assembly proves beneficial over conventional monopole audio assemblies in that the audio assembly yields improved sound quality in low frequencies, improved leakage reduction, and improved power efficiency. A dipole effect is created in a near field with the positive acoustic pressure waves and the negative acoustic pressure waves wherein the poles of the dipole being effectively the locations of the positive vent assembly and the negative vent assembly. Placing the positive vent assembly closer to a user's ear than the negative vent assembly results in the user's ear being closer to one pole of the dipole. This improves the bass response at low frequencies as less of the positive acoustic pressure waves are being destructively interfered with by the negative acoustic pressure waves.

Another benefit of the dipole audio assembly is leakage reduction, wherein leakage refers to the transmission of the acoustic pressure waves into the local area of the audio assembly, e.g., where other humans may hear acoustic pressure waves intended for the user of the audio assembly. In a far field, the positive acoustic pressure waves and the negative acoustic pressure waves destructively interfere (particularly at lower frequencies) reducing a degree of leakage. Note that the improvement in the bass response is dependent upon a distance between the positive vent assembly and the negative vent assembly. Accordingly, reducing the distance would likely diminish the bass response to the user as more of the negative acoustic pressure waves could be perceived by the user, but also would reduce leakage at higher acoustic frequencies (due to more destructive interference occurring at the shorter wavelengths).

The dipole audio assembly also improves power efficiency. In a conventional monopole audio assembly, a back chamber has a fixed volume of air that (i.e., not vented) effectively functions as a spring against the diaphragm. As the diaphragm displaces, the air in the back chamber is pressurized or depressurized placing a counteractive force on the diaphragm. This spring-like nature increases the amount of work on the transducer. In the dipole audio assembly, the back chamber with the volume of air is vented (e.g., via the negative vent assembly) removing the spring-like nature, thereby, improving power efficiency. Moreover, removal of the fixed-volume back chamber allows for reduction of form factor.

Embodiments of the invention may include or be implemented in conjunction with an artificial reality system. Artificial reality is a form of reality that has been adjusted in some manner before presentation to a user, which may include, e.g., a virtual reality, an augmented reality, a mixed reality, a hybrid reality, or some combination and/or derivatives thereof. Artificial reality content may include completely generated content or generated content combined with captured (e.g., real-world) content. The artificial reality content may include video, audio, haptic sensation, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a handheld device, a headset (e.g., an eyewear device, a head-mounted display (HMD) assembly with the eyewear device as a component, a HMD connected to a host computer system, a standalone HMD), a mobile device or computing system, or any other hardware platform capable of providing artificial reality content to one or more viewers. In addition, the artificial reality system may implement multiple input/output devices for receiving user input which may influence the artificial reality content provided to the user.

Headset

FIG. 1 is a perspective view of a headset 100, in accordance with one or more embodiments. The headset 100 presents content to a user. Examples of content presented by the headset 100 include visual content, audio content, haptic feedback content, artificial reality content, or some combination thereof. The headset 100 may be an eyewear device or a head-mounted display (HMD). The headset 100 includes, among other components, a front rigid body 105, a band 110, a plurality of cameras (i.e., cameras 115, 120, 125, 130), two audio assemblies (i.e., a left audio assembly 135, and a right audio assembly 140), a display system (not shown) and a sensor device 145. In other embodiments, the headset 100 may include fewer or additional components than those listed herein, a display system, haptic feedback devices, light sources, additional cameras, a controller, etc. Likewise, various operations described below may be variably distributed among components in the headset 100.

The front rigid body 105 holds the cameras 115, 120, 125, 130, the sensor device 145, and the display system (not shown). The front rigid body 105 couples to a user's face around the user's eyes. The front rigid body 105 has a front side that is an exterior surface of the front rigid body 105 directed away from the user's body when the headset 100 is worn. The front rigid body 105 holds within the display system, such that the display system can provide visual content to the user's eyes. The front rigid body 105 is attached to a band 110 which can be used to hold the front rigid body 105 to the user's face when the headset 100 is being worn by the user. The band 110 can be constructed by an elastic material providing sufficient force to hold the front rigid body 105 to the user's face.

The plurality of cameras, including the cameras 115, 120, 125, and 130, capture images of an environment of the headset 100. The plurality of cameras are placed on an external surface of the rigid body 105. In the embodiment shown in FIG. 1, camera 115 is oriented upwards and towards the right of the headset 100; camera 120 is oriented upwards and towards the left of the headset 100; camera 125 is oriented downwards and towards the left of the headset 100; and camera 130 is oriented downwards and towards the right of the headset 100. The cameras are placed on a substantially similar plane with fields of view that overlap in part, e.g., at least a pair of cameras have an overlapping fields of view. In some implementations, two or more cameras of the plurality of cameras may have fully overlapping fields of view. The cameras are capable of capturing images in a plurality of light channels, e.g., luma, infrared, red, green or blue. Each camera comprises at least a camera sensor capable of detecting light but may also include any optical element for focusing the light and such. In some embodiments, the camera sensor provides image data comprising intensity values at each pixel of light detected in each of the plurality of light channels. In other embodiments, the headset 100 may include additional cameras located anywhere around the front rigid body 105, e.g., for capturing images all around the headset 100. Image data comprising images or video captured by the cameras may be presented to a user of the headset 100. Additionally, the headset 100 may augment the image data in some manner to generate augmented reality content. Image data may further be relied on in depth sensing of an environment where the headset 100 is operating in.

The audio assemblies, including the left audio assembly 135 and the right audio assembly 140, provide audio content to a user of the headset 100. The audio assemblies are configured as dipole speakers emanating both a positive acoustic pressure wave and a negative acoustic pressure wave. As such, each audio assembly comprises an elongated body, a negative vent assembly, and a positive vent assembly. The elongated body includes an audio waveguide configured to direct positive acoustic pressure waves to an ear of the user. The negative vent assembly is configured to vent the negative acoustic pressure waves into free space. The positive vent assembly is configured to vent the positive acoustic pressure waves to the user's ear for providing audio content to the user. The positive vent assembly is closer to the user's ear than the negative vent assembly with the negative vent assembly placed in an indentation of the front rigid body 105. Placing the negative vent assembly farther from the user's ear than the positive vent assembly places the user's ear closer to one pole of the dipole (created by the positive vent assembly and the negative vent assembly) that improves bass response in low frequencies. The dipole also provides some leakage reduction (for low frequencies in particular) in a far field and provides improvements in power efficiency. The audio assembly will be further described in FIGS. 2-5.

The sensor device 145 detects movement of the headset 100. The sensor device 145 includes one or more position sensors and an inertial measurement unit (IMU). In some embodiments, the sensor device 145 is embedded into the front rigid body 105 underneath a surface layer rendering the sensor device 145 invisible to a user of the headset 100. The IMU is an electronic device that generates IMU data based on measurement signals received from one or more of the position sensors. A position sensor generates one or more measurement signals in response to motion of the headset 100. Examples of position sensors include: one or more accelerometers, one or more gyroscopes, one or more magnetometers, another suitable type of sensor that detects motion, a type of sensor used for error correction of the IMU, or some combination thereof. The position sensors may be located external to the IMU, internal to the IMU, or some combination thereof. The IMU and the position sensor will be discussed in greater detail in FIG. 7.

The display system (not shown) provides visual content. The display system has, among other components, an electronic display and an optics block. The electronic display generates image light according to visual content rendered to be presented to the user. The optics block directs the image light to an eye-box of the headset 100 where a user's eyes would be located when the headset 100 is properly worn. The display system may additional comprise other optical elements for various purposes, e.g., focusing of light, correcting for aberrations and/or distortions, magnifying light, directing light from an environment, etc. The display system will be discussed in greater detail in FIG. 7.

Figure 2:
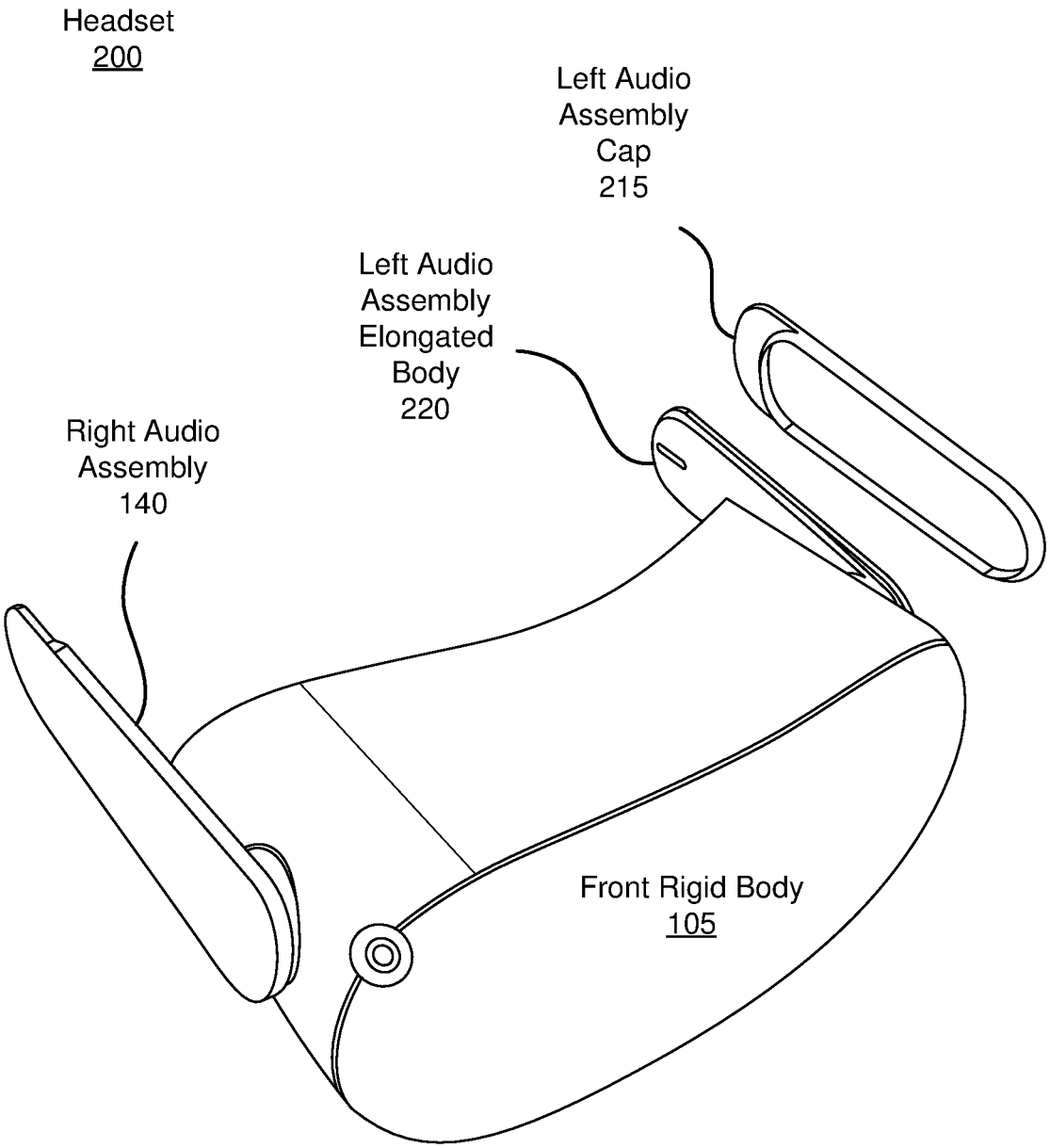
FIG. 2 is a perspective view of a portion of a headset partially disassembled, in accordance with one or more embodiments.

FIG. 2 is a perspective view of a portion of a headset 200 partially disassembled, in accordance with one or more embodiments. The headset 200 is an embodiment of the headset 100 of FIG. 1 including the front rigid body 105 and the two audio assemblies. The audio assemblies are removably coupled to the front rigid body 105 on a left side and right side. Each audio assembly further comprises a cap removably coupled to the elongated body. As shown in FIG. 2, the right audio assembly 140 has the cap currently coupled to the elongated body, whereas the left audio assembly 135 has the left audio assembly cap 215 decoupled from the left audio assembly elongated body 220. The cap is also attachable to the band 110. With this modular nature, a user may select from a range of sizes of audio assemblies to couple to the front rigid body 105 and the band 110 for their own comfort and convenience.

Dipole Audio Assembly

Figure 3:
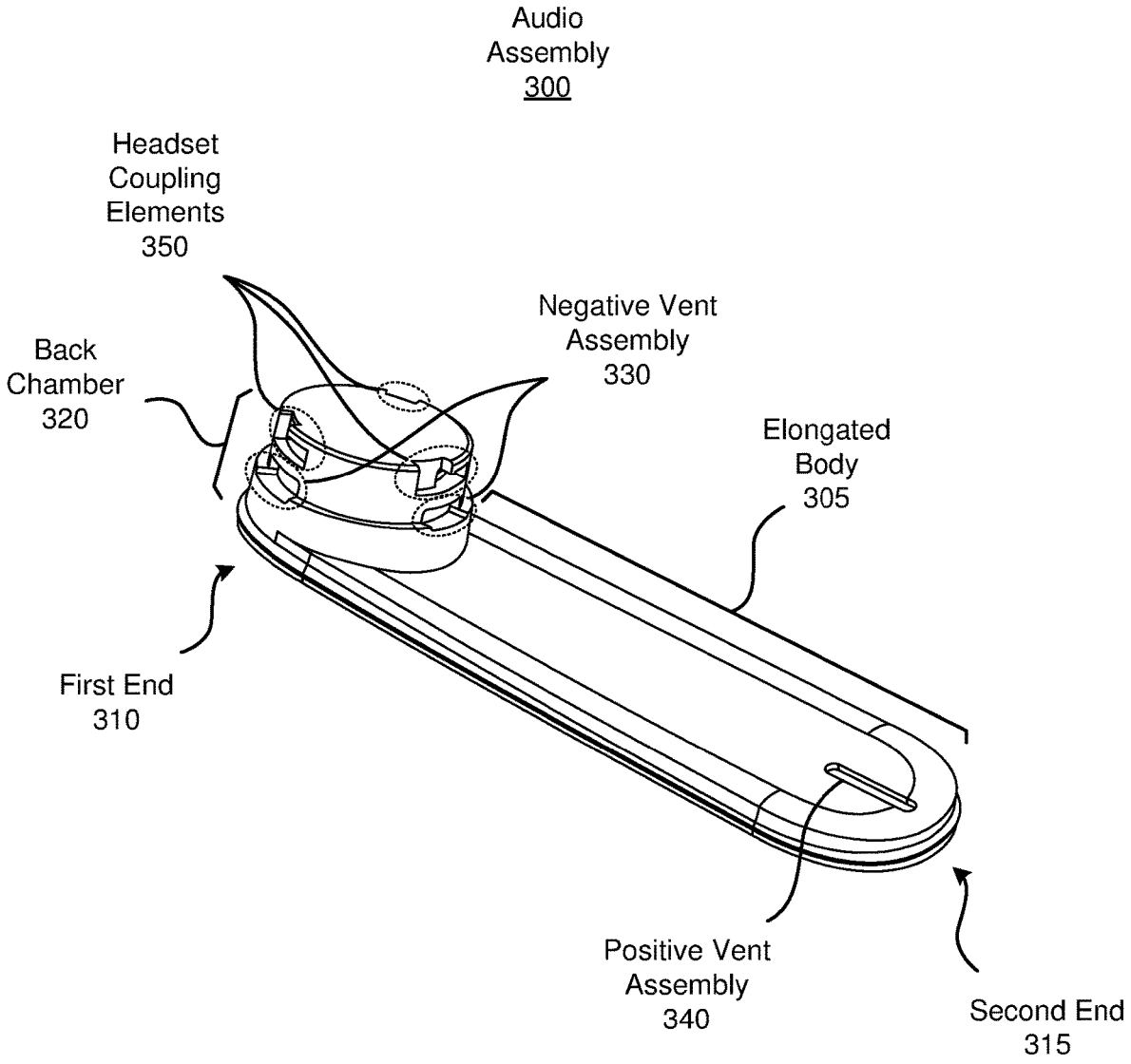
FIG. 3 is a perspective view of an audio assembly, in accordance with one or more embodiments.

FIG. 3 is a perspective view of an audio assembly 300, in accordance with one or more embodiments. The audio assembly 300 provides audio content to a user with a dipole effect by generating positive acoustic pressure waves and negative acoustic pressure waves that are vented into free space. The dipole effect is useful for reducing leakage in a far field and improving bass response in a near field given placement of a user's ear. In one or more embodiments, the audio assembly 300 provides acoustic pressure waves to a left or right ear of the user with an additional audio assembly 300 providing acoustic pressure waves to the other ear. The audio assembly 300 comprises an elongated body 305, a back chamber 320, a negative vent assembly 330, a positive vent assembly 340, and headset coupling elements 350. The audio assemblies 135 and 140 of FIG. 1 are embodiments of the audio assembly 300. The audio assembly 300 may comprise additional or fewer components listed herein, e.g., a cap that removably couples to the elongated body which may then removably couple to a band for securing the audio assembly 300 to a user's head (e.g., the band 110 which secures the audio assemblies 135 and 140 and the headset 100 to a user's head). With the audio assembly 300 coupled to a headset, e.g., the headset 100, and the headset appropriately worn by a user, the audio assembly 300 is situated proximate to a side of the user's head where the positive vent assembly 340 is closer to the user's ear corresponding to that side of the head than the negative vent assembly 330. This relative placement of the negative vent assembly 330 and the positive vent assembly 340 results in the user's ear being closer to one pole of the dipole than the other pole. This dipole effect provides some leakage reduction in the far field (for low frequencies in particular), improved bass response in the low frequencies, and power efficiency over conventional monopole audio speakers.

The elongated body 305 functions as an audio waveguide (not shown in FIG. 3) and includes the positive vent assembly 340. At the first end 310, the elongated body 305 is coupled to a transducer (not shown in FIG. 3) that generates the acoustic pressure waves. The elongated body 305 is also coupled to the back chamber 320 at the first end 310. The audio waveguide within the elongated body 305 directs the positive acoustic pressure waves generated from a front surface of the transducer from the first end 310 to the second end 315, the audio waveguide is further described in conjunction with FIG. 4. At the second end 315 of the elongated body, is the positive vent assembly 340 which vents the positive acoustic pressure waves for providing audio content to a user. The elongated body 305 may have a substantially flat profile, i.e., at a cross sectional portion of the elongated body 305, the width of the elongated body 305 is substantially larger than the height of the elongated body 305. The elongated body 305 may further have a twist such that the first end of the audio waveguide is rotated relative to the second end of the audio waveguide. A degree of the twist may conform generally to a contour of a human head.

A length of the audio waveguide may affect characteristics of the dipole effect created by the audio assembly 300. The length of the audio waveguide affects a distance between the negative vent assembly 330 and the positive vent assembly 340. As discussed above, the locations of the negative vent assembly 330 and the positive vent assembly 340 effectively correspond to poles of the dipole created by the audio assembly 300. A longer dipole, i.e., a greater distance between the negative vent assembly 330 and the positive vent assembly 340, diminishes the bass response but would also reduce leakage at higher acoustic frequencies.

The back chamber 320 holds the negative vent assembly 330 and the headset coupling elements 340. The back chamber 320 is coupled to the first end 310 of the elongated body 305 and to the transducer located at the junction between the elongated body 305 and the back chamber 320. A back surface of the transducer (not shown) generates negative acoustic pressure waves that fill into the back chamber 320. The back chamber forms the negative vents of the negative vent assembly 330 which is configured to vent the negative acoustic pressure waves generated from the back surface of the transducer, e.g., for improving bass response and leakage reduction. The headset may comprise an indentation substantially sized in complement to the back chamber 320. In some embodiments, the back chamber 320 and the elongated body 305 are monolithically manufactured.

The negative vent assembly 330 vents negative acoustic pressure waves, e.g., for improving bass response and leakage reduction. The negative vent assembly 330 comprises one or more negative vents that vent negative acoustic pressure waves into free space. The number of negative vents, the shape of the negative vents, the size of the negative vents, or any combination thereof may vary in various implementations. For example, one implementation may utilize four negative vents in the negative vent assembly 330. In some embodiments, each negative vent may include a negative vent mesh to prevent dust from reaching the transducer. The negative vent assembly 330, as shown in FIG. 3, includes three negative vents that are substantially elliptical and equally spaced around the back chamber 320. Two of the negative vents are in view with a third negative vent occluded from the perspective view. The configuration of the negative vents (i.e., number of negative vents, shape, size) influences one or more characteristics of the vented negative acoustic pressure waves which may affect the leakage reduction, the bass response, the power efficiency, or any combination thereof. These characteristics may include amplitude, frequencies, reverberation, distortion, another characteristic of acoustic pressure waves, or any combination thereof. Corresponding to the audio assembly 300 pictured in FIG. 3, the negative vent assembly 330 comprises three negative vents with two visible and one occluded, i.e., on the opposite side of the back chamber 320.

The positive vent assembly 340 vents positive acoustic pressure waves for providing audio content to a user. The positive vent assembly 340 comprises at least one positive vent that vents positive acoustic pressure waves into free space. The vented positive acoustic pressure waves are detectable by a user's ear as the audio content. In a similar manner as described for the negative vent assembly 330, configuration of the positive vent assembly 340 may vary in number of positive vents, shape of positive vents, size of positive vents, or any combination thereof, which influences one or more characteristics of the vented positive acoustic pressure waves (e.g., amplitude, frequencies, reverberation, distortion, etc.). As shown in FIG. 3, the positive vent assembly 340 comprises one positive vent of an elliptical shape on the order of 0.5 square centimeters ($cm^2$) placed on a side of the elongated body that would be oriented towards a user's ear. With the audio assembly 300 coupled to a headset, e.g., the headset 100, the positive vent is located to be closer to a user's ear than the negative vents of the negative vent assembly. Placing the user's ear close to the positive vent assembly (i.e., one pole of the dipole) allows for the benefits of the dipole effect, the benefits including the improved bass response in low frequencies and improved leakage reduction.

In some embodiments, a configuration of the positive vent assembly 340 and a configuration of the negative vent assembly 330 affect the dipole effect. In one aspect, a total open area corresponding to positive vents of the positive vent assembly 340 and/or a total open area of negative vents of the negative vent assembly 330 affect a strength of the dipole effect. The total open area of the positive vent assembly 340 corresponds to an aggregate area of one or more openings of the one or more positive vents of the positive vent assembly 340. Similarly, the total open area of the negative vent assembly 330 corresponds to an aggregate area of one or more openings of the one or more negative vents of the negative vent assembly 330. As either the total open area of the negative assembly 330 or the total open area of the positive vent assembly 340 is significantly lower than the other, the strength of the dipole effect diminishes as the influence of vented acoustic pressure waves from either the positive vent assembly 340 or the negative vent assembly 330 is greatly diminished compared to vented acoustic pressure waves from the other vent assembly. The configuration of the positive vent assembly 340 and the configuration of the negative vent assembly 330 may be optimized according to a strength of the dipole effect to be achieved by the audio assembly 300. As mentioned, the strength of the dipole effect affects the bass response in the low frequencies and the leakage reduction.

The configurations of the positive vent assembly 340 and the negative vent assembly 330 can also affect the power efficiency. The power efficiency of the audio assembly 300 also directly depends on the total open area of the negative vent assembly 330 and the total open area of the positive vent assembly 340. As such, the power efficiency increases with the total open area of the negative vent assembly 330 and/or the total open area of the positive vent assembly 340. Understandably, if the opening on either end of the audio assembly 300 is smaller, then less air can be displace in and out which can build up pressure in the elongated body 305 and/or the back chamber 350 requiring the transducer to work harder thereby reducing power efficiency of the audio assembly 300. The converse also holds, as the opening on either end of the audio assembly 300 is bigger, move air can be displaced through the openings which reduces the difficulty on the transducer yielding improved power efficiency of the audio assembly 300.

The headset coupling elements 350 couples the audio assembly 300 to a headset, e.g., the headset 100. The headset coupling elements 350 may be implemented as a physical coupling mechanism, a magnetic coupling mechanism, or a combination thereof. With a physical coupling mechanism, the headset coupling elements 350 may be physical structures on the back chamber 320 that couple with complementary physical structures on the headset. With a magnetic coupling mechanism, the headset coupling elements 350 may be magnets or magnetic elements attracted to magnets. The headset comprises magnets or magnetic elements that attract to the headset coupling elements 350 for coupling the audio assembly 300 to the headset. In the embodiment shown in FIG. 3, the headset coupling elements are hook-like structure embedded in the back chamber 320 portion of the audio assembly 300. The hook-like structure hooks to a corresponding structure on the headset. In some embodiments, one or more of the headset coupling elements 350 are formed by the elongated body 305 and/or the back chamber 320, e.g., the headset coupling elements 350 are hook-like structures embedded in (in other words, formed by) the back chamber 320. In other embodiments, one or more of the headset coupling elements 350 may be separate components that are attached onto the elongated body 305 and/or the back chamber 320, e.g., the headset coupling elements 350 are magnets attached to the back chamber 320. In other embodiments, the headset coupling elements 350 are located elsewhere on the audio assembly 300, e.g., on the elongated body 305.

Figure 4:
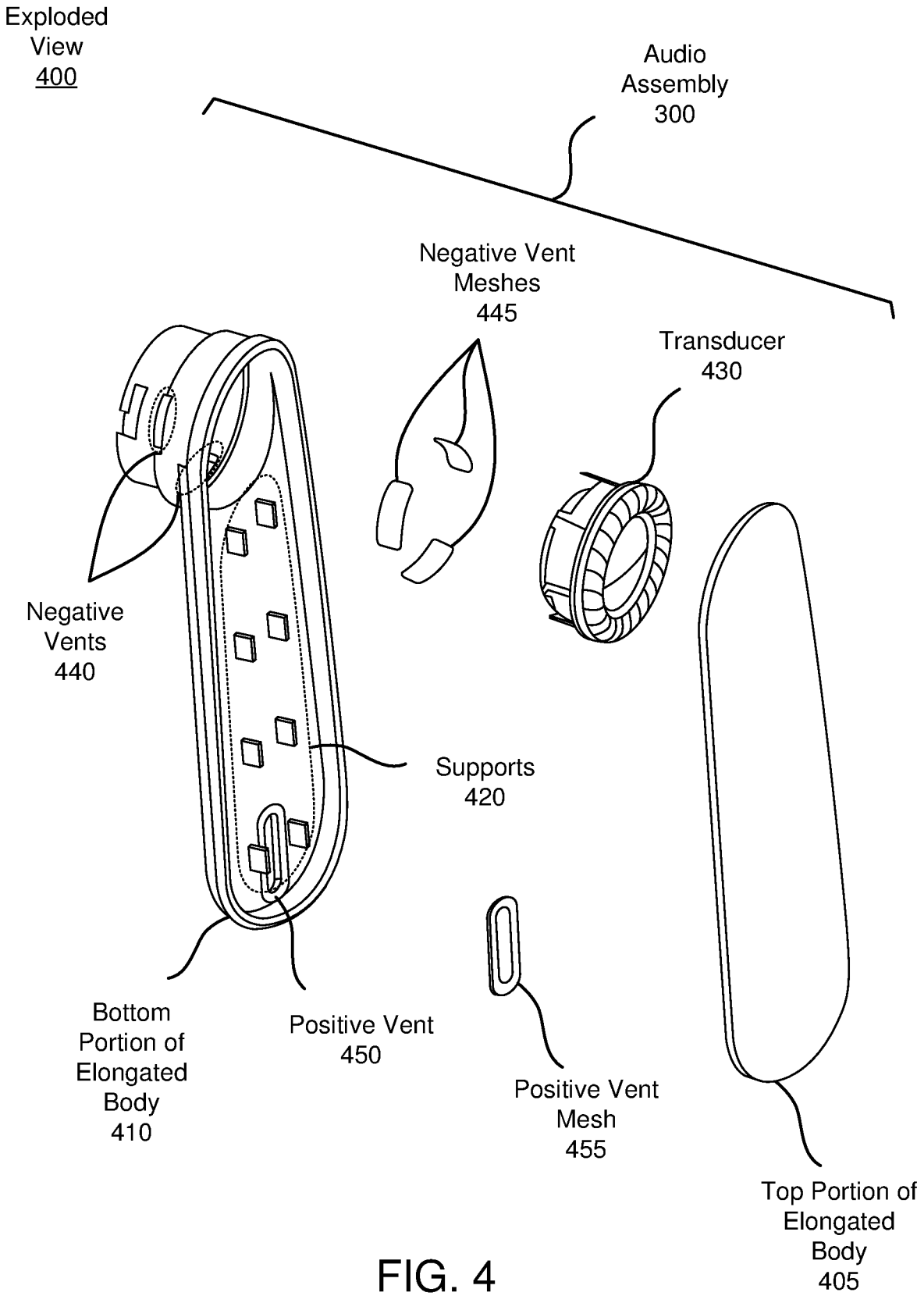
FIG. 4 is an exploded view of the audio assembly of FIG. 3.

FIG. 4 is an exploded view 400 of the audio assembly 300 of FIG. 3. The exploded view 400 illustrates various components implemented within the audio assembly 300: a top portion 405 of elongated body 305, a bottom portion 410 of elongated body 305, a plurality of supports 420, a transducer 430, a plurality of negative vents 440, a plurality of negative vent meshes 445, a positive vent 450, and a positive vent mesh.

The top portion 405 of the elongated body 305 and the bottom portion 410 of the elongated body 305 couple together to form the elongated body 305 of FIG. 3. With the top portion 405 coupled to the bottom portion 410, the elongated body 305 forms a cavity that substantially constitutes the audio waveguide. The dimensions of the cavity influence the propagation of the acoustic pressure waves. As shown in FIG. 4, the cavity formed by the elongated body 305 is substantially an elliptical prism. The supports 420 may further provide structural support of the cavity. As shown in FIG. 4, there are eight supports 420 that are thin square prisms (more or less) evenly arranged along a length of the audio waveguide. The configuration of the cavity may vary over size, shape, material that composes the elongated body 305, material that may coat an inside surface of the cavity, number of supports 420, shape of the supports 420, size of the supports 420, material of the supports 420, placements of the supports 420, or any combination thereof. For example, a size and/or a shape of the cavity may be optimized to be more conducive for propagation for a range of frequencies. Number and/or placements of the supports 420 In another example, the material of the elongated body 305 and/or the supports 420 may vary in elasticity which influences reflection of acoustic pressure waves, thereby transmission of the audio waveguide. This may be similar if the cavity and/or supports 420 have a coating of another material, wherein the coating of the material may also affect reflective properties of the acoustic pressure waves.

The transducer 430 generates positive acoustic pressure waves and negative acoustic pressure waves. The transducer 430 comprises at least a diaphragm supported on a frame. The diaphragm is controlled to displace to generate the acoustic pressure waves. When oscillating, a front surface of the diaphragm corresponding to the front surface of the transducer 430 generates a positive acoustic pressure wave while the back surface of the diaphragm corresponding to the back surface of the transducer 430 generates a negative acoustic pressure wave. There are various mechanisms that may be implemented for driving the displacement of the diaphragm. In one or more implementations, the transducer 430 is a voice coil transducer wherein a voice coil electromagnet may be electrically controlled to drive the diaphragm. Another set of implementations utilize electrostatic transducers with a flexible conductive membrane controllable by electrically conductive grids sandwiched on either side of the membrane which are able to drive displacement of the membrane with electrostatic forces. Other implementations or variations of the above implementations may include but are not limited to piezoelectric transducers, armature transducers, other mechanical transducers, or any combination thereof.

Referring back to FIG. 4, the negative vents 440 vent negative acoustic pressure waves into free space. The negative vents 440 are openings in the back chamber 320 that allow air and consequently acoustic pressure waves to pass through the openings. The negative vents 440, as mentioned above, may vary in configuration with any combination of number of negative vents 440, shape of negative vents 440, size of negative vents 440, etc. The amount of air or negative acoustic pressure waves that can vent through the negative vents 440 thus depends on the aggregate surface area of the openings of all the negative vents 440. In some embodiments, the negative vent meshes 445 are placed over the negative vents. The negative vent meshes 445 may serve a variety of functions, primarily, preventing dust or other particles to enter the back chamber 320 or diffusing certain frequencies of the negative acoustic pressure waves. The negative vent meshes 445 may be constructed from cloth, metal, plastic, another material, or any combination thereof.

The positive vent 450 vents positive acoustic pressure waves into free space. The positive vent 450 is an opening on the bottom portion 410 of the elongated body 305. With the audio assembly 300 coupled to a headset, e.g., the headset 100, the bottom portion 410 of the elongated body may be oriented towards the side of the user's head with the top portion 405 of the elongated body 305 oriented away from the user's head. The positive vent 450 in one or more embodiments is a slit. In other embodiments the positive vent 450 is another shape, another size, another orientation, placed on the top portion 405 of the elongated body 305, place elsewhere on the elongated body 305, or any combination thereof. The positive vent mesh 455 covers the positive vent 450 but its construction and operation is substantially similar to the negative vent meshes 445, thus details thereof are omitted herein for brevity.

Figure 5:
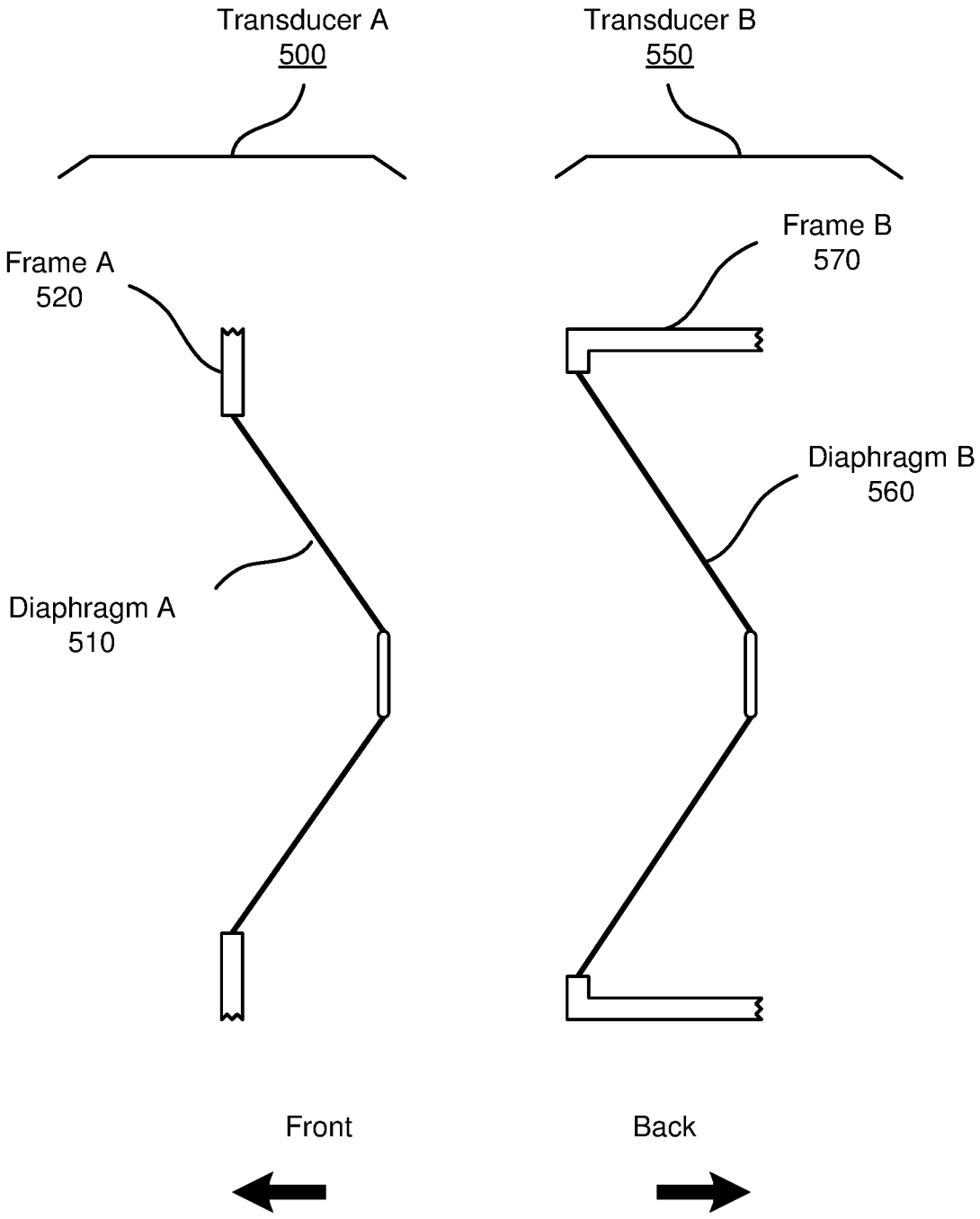
FIG. 5 is a cross section view of two types of transducers of an audio assembly, in accordance with one or more embodiments.

FIG. 5 is a cross section view of two types of transducers of an audio assembly, in accordance with one or more embodiments. Transducer A 500 and transducer B 550 are voice coil speakers that may be implemented as transducer 430 in FIG. 4. Transducer A 500 and transducer B 550 are simplified abstractions of voice coil speakers showing each transducer as having a conical diaphragm and a frame. In reality, both have various other components including the voice coil portion that drives the diaphragm. In abstraction, transducer A 500 comprises diaphragm A 510 and frame A 520, and transducer B 550 comprises diaphragm 560 and frame 570. In transducer A 500, frame A 520 near diaphragm A 510 is substantially planar. In transducer B 550, frame B 570 near diaphragm B 560 is L-shaped, wherein diaphragm B 560 is coupled to a small ledge of frame B 570 with the longer portion of frame B 570 extending backwards. In comparing transducer A 500 and transducer B 550, the l-shaped frame of transducer B 550 allows for maximization of a diameter of the diaphragm within a fixed width of the transducers. Maximizing the diameter of the diaphragm optimizes power efficiency in generating the acoustic pressure waves as a larger diaphragm is able to displace more air when displaced the same amount as a smaller diaphragm.

Figure 6A:
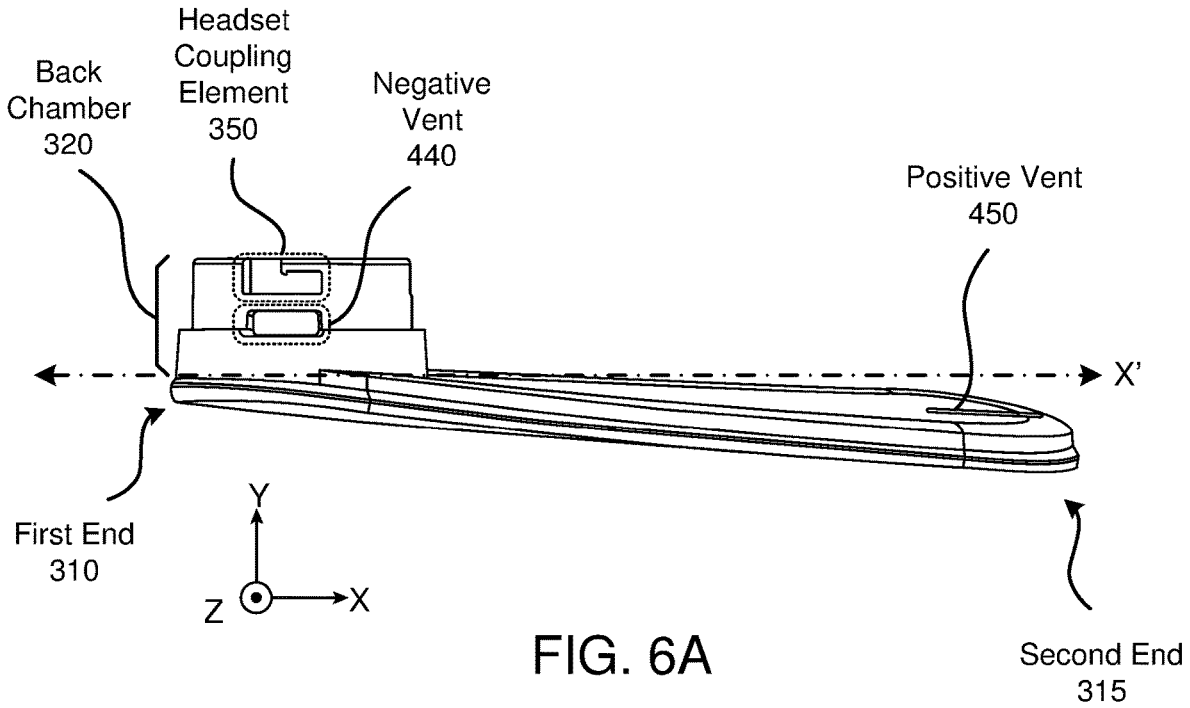
FIG. 6A is a first view of the left audio assembly of FIG. 1.

FIG. 6A is a first view 610 of the left audio assembly 135 of FIG. 1. As mentioned, the left audio assembly 135 is an embodiment of the audio assembly 300. In the first view 610 shown in FIG. 6A, the paper is on the XY-plane with the Z-axis coming out of the page. Noticeably, the first end 310 of the elongated body 305 is rotated relative to the second end 315 of the elongated body 305 along the X'-axis parallel to the X-axis. The first view 610 also shows one of three headset coupling element 350 and one of three negative vents 440 of the negative vent assembly 330 located on the back chamber 320. The first view 610 also shows the positive vent 450 of the positive vent assembly 340.

Figure 6B:
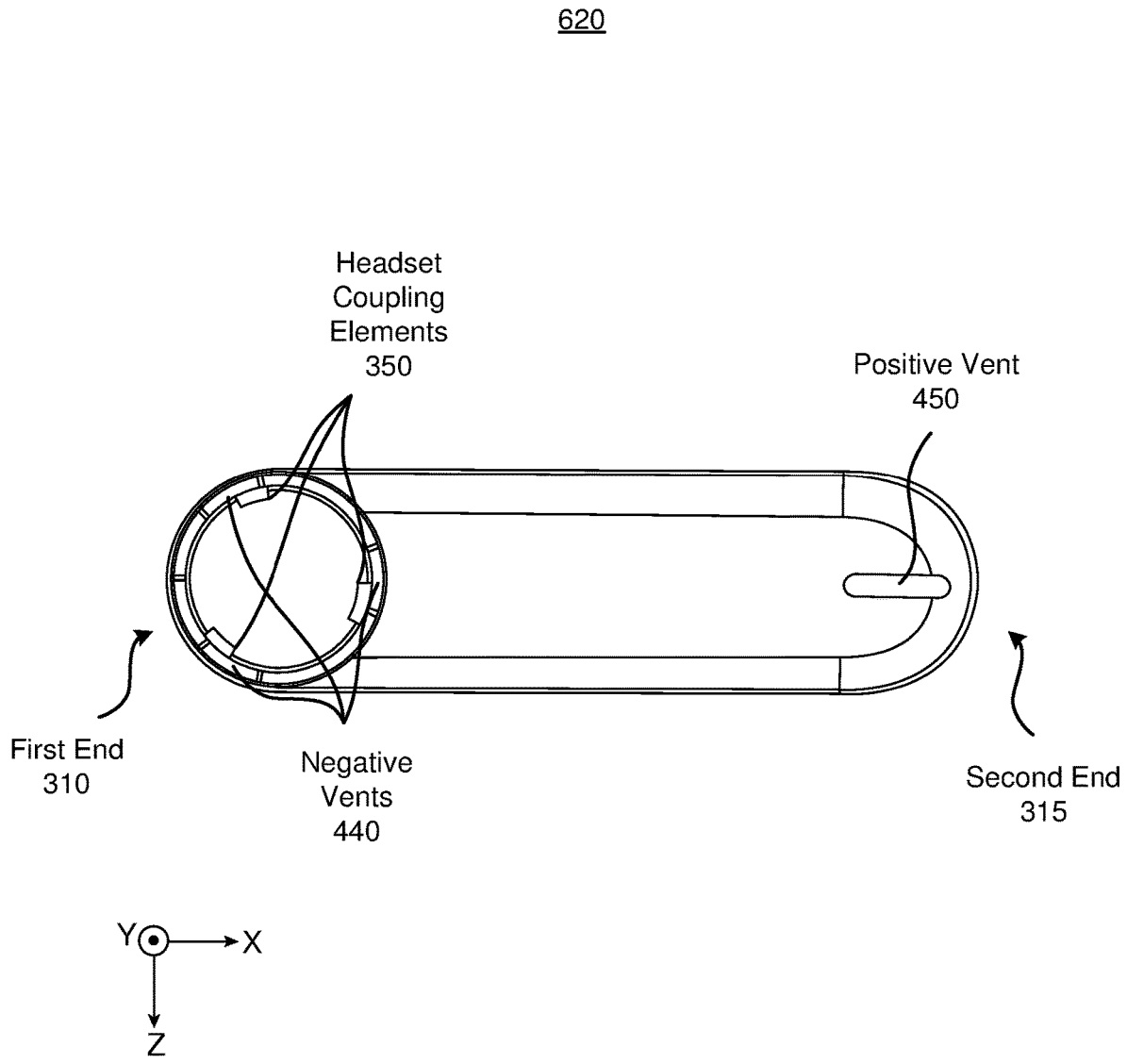
FIG. 6B is a second view of the left audio assembly of FIG. 1.

FIG. 6B is a second view 620 of the left audio assembly 135 of FIG. 1. In the second view 620 shown in FIG. 6B, the paper is on the XZ-plane with the Y-axis coming out of the page. From this perspective, the three negative vents 440 of the negative vent assembly 330 are spaced evenly around the back chamber 320. Similarly, the three headset coupling elements 350 are spaced evenly around the back chamber 320. The positive vent 450 is located on the second end 315 of the elongated body 305.

Figure 6C:
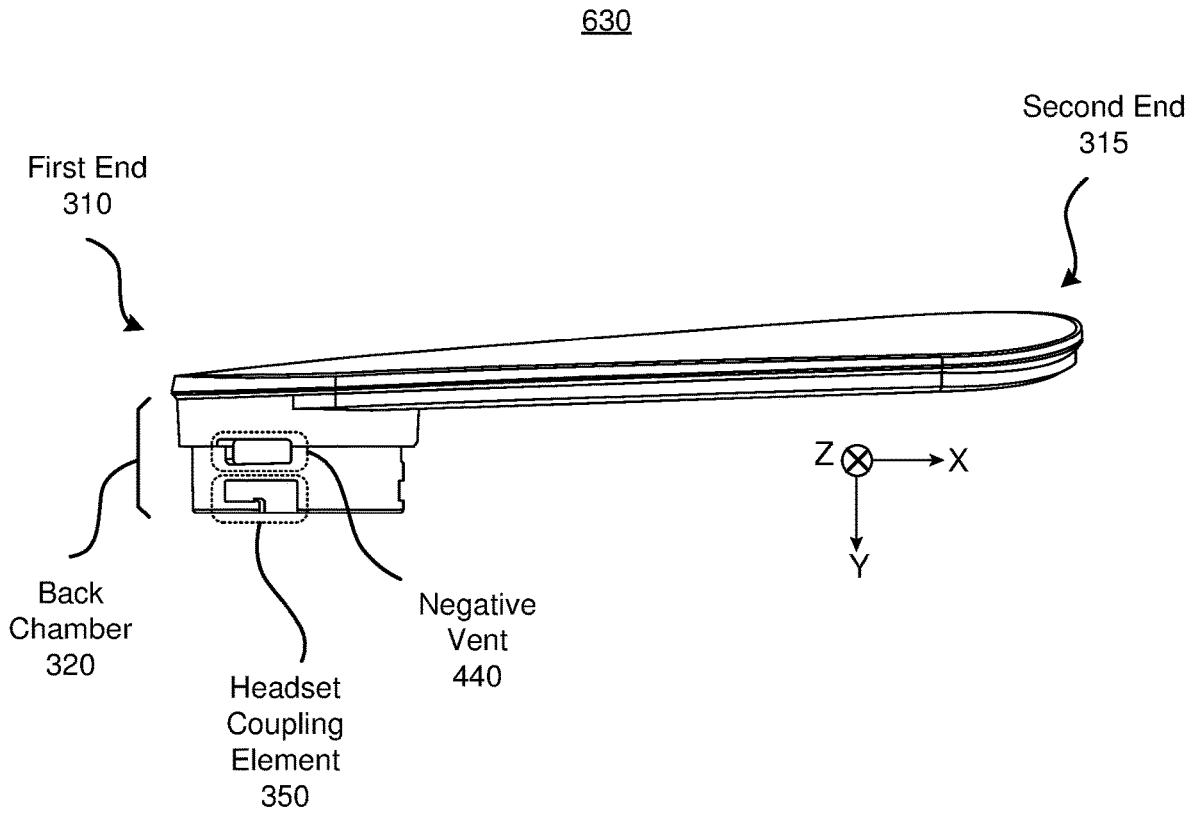
FIG. 6C is a third view of the left audio assembly of FIG. 1.

FIG. 6C is a third view 630 of the left audio assembly 135 of FIG. 1. In the third view 630 shown in FIG. 6C, the paper is on the XY-plane with the Z-axis going into the page. From this perspective, one of the three negative vents 440 of the negative vent assembly 330 and one of the three headset coupling elements 350 are shown on the back chamber 320. The twist present in the elongated body 305 is also noticeable from this perspective; however, the positive vent 450 is now occluded compared to the first view 610 of FIG. 6A.

Figure 6D:
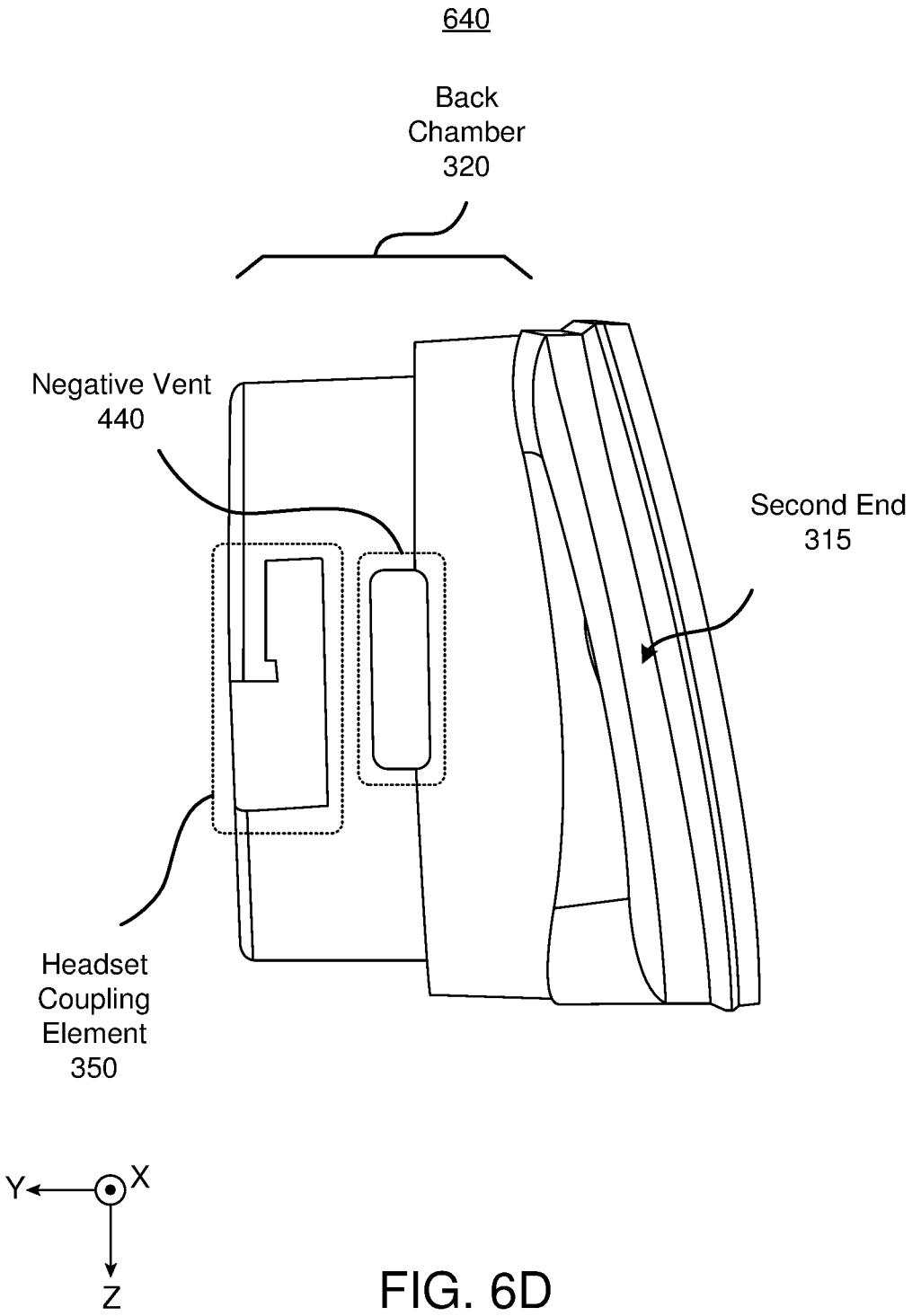
FIG. 6D is a fourth view of the left audio assembly of FIG. 1.

FIG. 6D is a fourth view 640 of the left audio assembly 135 of FIG. 1. In the fourth view 640 shown in FIG. 6D, the paper is on the YZ-plane with the X-axis coming out of the page. This perspective looks at the left audio assembly 135 from the second end 315 down. In this perspective, one of the three negative vents 440 of the negative vent assembly 330 and one of the three headset coupling elements 350 are shown on the back chamber 320. From this perspective, the positive vent 450 is configured to vent the positive acoustic pressure waves generally towards the positive Y-axis.

Figure 6E:
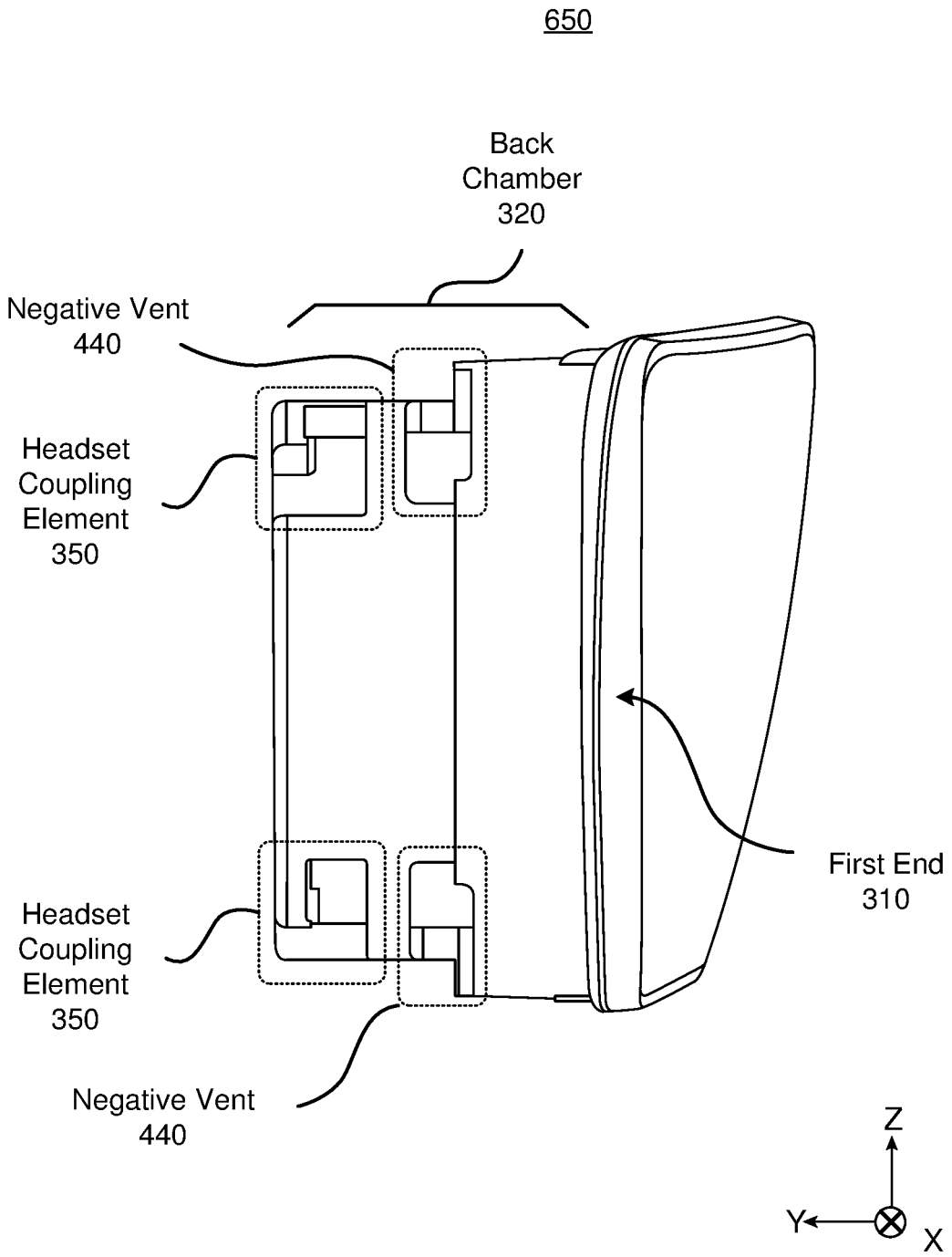
FIG. 6E is a fifth view of the left audio assembly of FIG. 1.

FIG. 6E is a fifth view 650 of the left audio assembly 135 of FIG. 1. In the fifth view 650 shown in FIG. 6E, the paper is on the YZ-plane with the X-axis going into the page. This perspective looks at the left audio assembly 135 from the first end 310 down. In this perspective, two of the three negative vents 440 of the negative vent assembly 330 and two of the three headset coupling elements 350 are shown on the back chamber 320. From this perspective, the positive vent 450 is also occluded.

Artificial Reality System Environment

Figure 7:
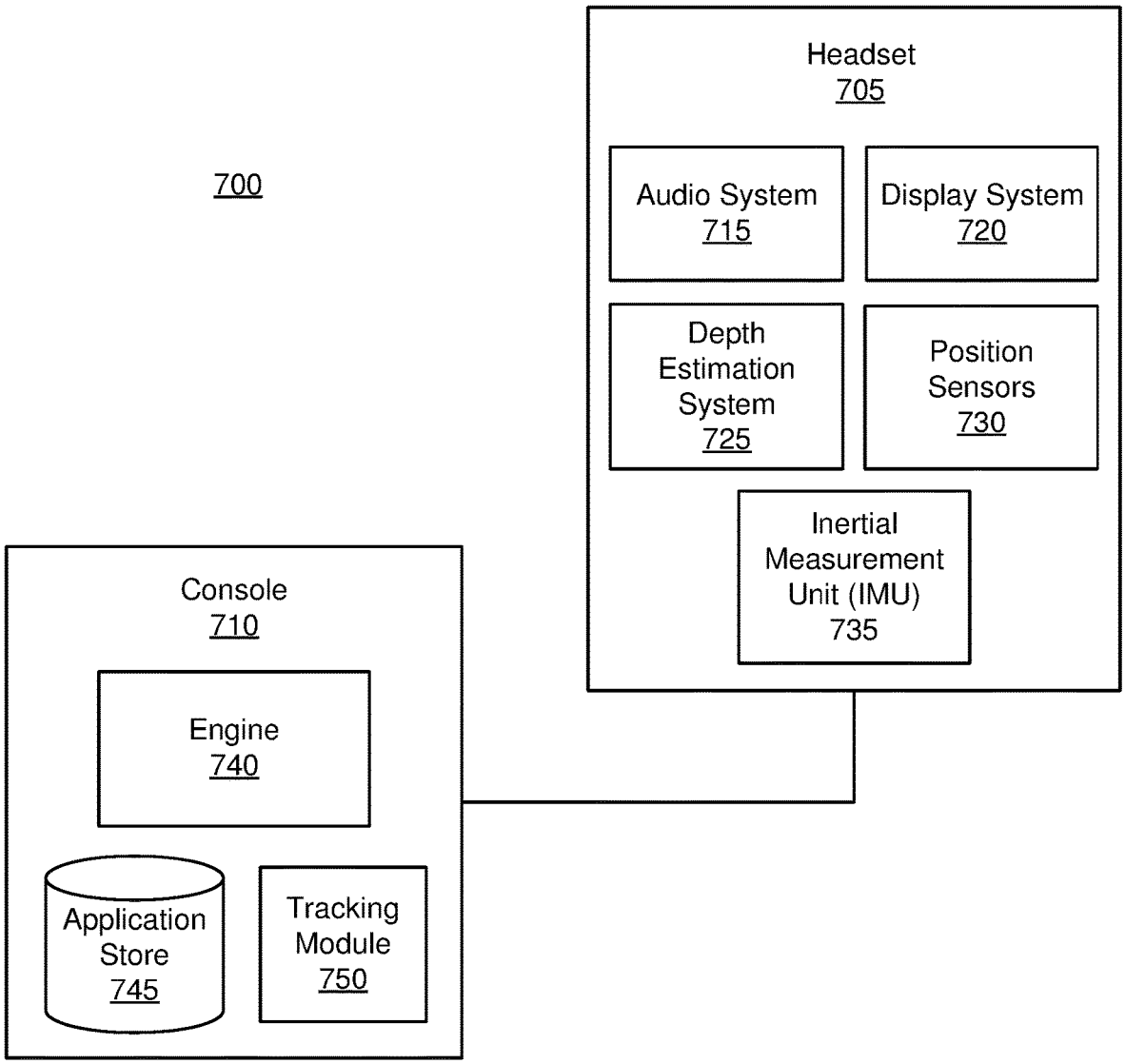
FIG. 7 is a system environment of an artificial reality system including a headset, in accordance with one or more embodiments.

FIG. 7 is a system environment of an artificial reality system 700 including a headset, in accordance with one or more embodiments. The system 700 may operate in an artificial reality context, e.g., a virtual reality, an augmented reality, a mixed reality context, or some combination thereof. The system 700 shown by FIG. 7 comprises a headset 705 and may additionally include other input/output (I/O) devices (not shown) that may be coupled to a console 710. The headset 100 is one embodiment of the headset 705. While FIG. 7 shows an example system 700 including one headset 705, in other embodiments, any number of additional components may be included in the system 700. In alternative configurations, different and/or additional components may be included in the system 700. Additionally, functionality described in conjunction with one or more of the components shown in FIG. 7 may be distributed among the components in a different manner than described in conjunction with FIG. 7 in some embodiments. For example, some or all of the functionality of the console 710 may be integrated into the headset 705.

The headset 705 presents content to a user. The headset 705 may be an eyewear device, a head-mounted display, an earbud, a headphone, or another type of device placed on a head. In some embodiments, the presented content includes audio content via an audio system 715, visual content via a display system 720, haptic feedback from one or more haptic feedback devices (not shown in FIG. 7), etc. In some embodiments, the headset 705 presents virtual content to the user that is based in part on depth information of a real local area surrounding the headset 705. For example, the user wearing the headset 705 may be physically in a room, and virtual walls and a virtual floor corresponding to walls and floor in the room are rendered as part of the virtual content presented by the headset 705. In another example, a virtual character or a virtual scene may be rendered as an augmentation to views of the real world through the headset 705.

The headset 705 includes an audio system 715, a display system 720, a depth estimation system 725, position sensors 730, and an inertial measurement Unit (IMU) 735. Some embodiments of the headset 705 have different components than those described in conjunction with FIG. 7. Additionally, the functionality provided by various components described in conjunction with FIG. 7 may be differently distributed among the components of the headset 705 in other embodiments, or be captured in separate assemblies remote from the headset 705. In one or more examples, the headset 705 includes an eye-tracking system, a haptic feedback system, one or more light sources (e.g., for structured illumination light), etc.

The audio system 715 presents audio content to a user of the headset 705. The audio content may be provided by the console 710 to be presented by the headset 705. The audio system 715 comprises one or more audio assemblies that generate acoustic pressure waves that constitute the audio content provided to the user of the headset 705. The audio assemblies may be embodiments of the audio assembly 300, e.g., one or more audio assemblies coupled to each ear of the user. The audio assemblies are configured as dipole speakers emanating both positive pressure acoustic pressure waves and negative acoustic pressure waves. At least one of the audio assemblies comprises an elongated body including an audio waveguide, a negative vent assembly, a positive vent assembly, and a transducer. The negative vent assembly is coupled to the elongated body and includes at least one negative vent that vents negative acoustic pressure waves generated by a back surface of a transducer coupled to a first end of the audio waveguide within the elongated body. The positive vent assembly is part of the elongated body and coupled to a second, opposite end of the audio waveguide. The positive vent assembly includes at least one positive vent that vents positive acoustic pressure waves generated by a front surface of the transducer. The vented acoustic pressure waves from the negative vent assembly and the positive vent assembly traverse free space to the user's ears which are then perceived as at least a portion of the audio content. In other embodiments, the audio system 715 incorporates other types of audio assemblies that may provide some portion of the audio content, e.g., via bone conduction.

The following process examples how the audio assembly provides audio content. The audio system 715 obtains audio content to be provided to the user. The audio system 715 identifies one or more of the audio assemblies to instruct to provide at least a portion of the audio content. Each audio assembly that is designated drives the transducer of the audio assembly to generate positive acoustic pressure waves from the front surface of the transducer and negative acoustic pressure waves from the back surface of the transducer. The positive acoustic pressure waves propagate down the audio waveguide and are vented by the positive vent assembly into free space. The negative acoustic pressure waves fill a back chamber coupled to the back side of the transducer and are vented by the negative vent assembly into free space. A user's ear detects the vented positive acoustic pressure waves from the positive vent assembly, whereby the user perceives the audio content. By placing the positive vent assembly closer to a user's ear than the negative vent assembly, a dipole is created between the vented positive acoustic pressure waves and the vented negative acoustic pressure waves, which can improve bass response in the low frequencies compared to conventional monopole audio speakers.

The display system 720 presents visual content to a user of the headset 705. The visual content presented may take into account depth information determined by the depth estimation system 725. The display system 720 may comprise an electronic display and an optics block. The electronic display displays 2D or 3D images to the user in accordance with data received from the console 710. In various embodiments, the electronic display comprises a single electronic display or multiple electronic displays (e.g., a display for each eye of a user). Examples of the electronic display include: a liquid crystal display (LCD), an organic light emitting diode (OLED) display, an active-matrix organic light-emitting diode display (AMOLED), a waveguide display, some other display, or some combination thereof.

The optics block magnifies image light received from the electronic display, corrects optical errors associated with the image light, and presents the corrected image light to a user of the headset 705. In various embodiments, the optics block includes one or more optical elements. Example optical elements included in the optics block include: a waveguide, an aperture, a Fresnel lens, a convex lens, a concave lens, a filter, a reflecting surface, or any other suitable optical element that affects image light. Moreover, the optics block may include combinations of different optical elements. In some embodiments, one or more of the optical elements in the optics block may have one or more coatings, such as partially reflective or anti-reflective coatings.

Magnification and focusing of the image light by the optics block allows the electronic display to be physically smaller, weigh less, and consume less power than larger displays. Additionally, magnification may increase the field of view of the content presented by the electronic display. For example, the field of view of the displayed content is such that the displayed content is presented using almost all (e.g., approximately 110 degrees diagonal), and in some cases, all of the user's field of view. Additionally, in some embodiments, the amount of magnification may be adjusted by adding or removing optical elements.

In some embodiments, the optics block may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display for display is pre-distorted, and the optics block corrects the distortion when it receives image light from the electronic display generated based on the content.

The depth estimation system 725 determines depth information of an environment around the headset 705. The depth information may include a depth map of the environment at an instant of time. The depth estimation system 725 comprises two or more cameras, e.g., the cameras 115, 120, 125, and 130, and a controller. The cameras capture images of the environment with some overlapping field of view. With the captured images, the depth estimation system 725 can use any of numerous imaging analysis techniques to determine correspondences between the captured image which may be used for depth estimation. In other embodiments, the depth estimation system 725 assesses other data received by other components of the headset 705 to determine depth information, e.g., movement. For example, the headset 705 may include proximity sensors that can be also be used alone or in conjunction with the captured images to determine depth information. The depth information determined by the depth estimation system 725 may be used to improve content presented by the headset 705.

The IMU 735 is an electronic device that generates data indicating a position of the headset 705 based on measurement signals received from one or more of the position sensors 730. A position sensor 730 generates one or more measurement signals in response to motion of the headset 705. Examples of position sensors 730 include: one or more accelerometers, one or more gyroscopes, one or more magnetometers, another suitable type of sensor that detects motion, a type of sensor used for error correction of the IMU 735, or some combination thereof. The position sensors 730 may be located external to the IMU 735, internal to the IMU 735, or some combination thereof.

Based on the one or more measurement signals from one or more position sensors 730, the IMU 735 generates head-tracking data indicating an estimated current position of the headset 705 relative to an initial position of the headset 705. For example, the position sensors 730 include multiple accelerometers to measure translational motion (forward/back, up/down, left/right) and multiple gyroscopes to measure rotational motion (e.g., pitch, yaw, and roll). In some embodiments, the IMU 735 rapidly samples the measurement signals and calculates the estimated current position of the headset 705 from the sampled data. For example, the IMU 735 integrates the measurement signals received from the accelerometers over time to estimate a velocity vector and integrates the velocity vector over time to determine an estimated current position of a reference point on the headset 705. Alternatively, the IMU 735 provides the sampled measurement signals to the console 710, which interprets the head-tracking data to reduce error. The reference point is a point that may be used to describe the position of the headset 705. The reference point may generally be defined as a point in space or a position related to the headset's 505 orientation and position.

The console 710 provides content to the headset 705 for processing in accordance with information received from the headset 705. In the example shown in FIG. 7, the console 710 includes an application store 745, a tracking module 750, and an engine 740. Some embodiments of the console 710 have different modules or components than those described in conjunction with FIG. 7. Similarly, the functions further described below may be distributed among components of the console 710 in a different manner than described in conjunction with FIG. 7.

The application store 745 stores one or more applications for execution by the console 710. An application is a group of instructions that, when executed by a processor, generates content for presentation to the user. Content generated by an application may be in response to inputs received from the user via movement of the headset 705 or any input/output devices. Examples of applications include: gaming applications, conferencing applications, video playback applications, or other suitable applications.

The tracking module 750 calibrates the system environment using one or more calibration parameters and may adjust one or more calibration parameters to reduce error in determination of the position of the headset 705. Calibration performed by the tracking module 750 also accounts for information received from the IMU 735 in the headset 705. Additionally, if tracking of the headset 705 is lost, the tracking module 750 may re-calibrate some or all of the system environment.

The tracking module 750 tracks movements of the headset 705 as head-tracking data using information from the one or more position sensors 730, the IMU 735, or some combination thereof. For example, the tracking module 750 determines a position of a reference point of the headset 705 in a mapping of a local area based on information from the headset 705. Additionally, in some embodiments, the tracking module 750 may use portions of information to predict a future position of the headset 705. The tracking module 750 provides the head-tracking data inclusive of the estimated and/or predicted future position of the headset 705 to the engine 740.

The engine 740 also executes applications within the system environment and receives depth information from the depth estimation system 725, position information, acceleration information, velocity information, predicted future positions, or some combination thereof, of the headset 705 from the tracking module 750. Based on the received information, the engine 740 determines content to provide to the headset 705 for presentation to the user. For example, if the received information indicates that the user has looked to the left, the engine 740 generates content for the headset 705 that mirrors the user's movement in a virtual environment or in an environment augmenting the local area with additional content. Additionally, the engine 740 performs an action within an application executing on the console 710, in response to any inputs received from headset 705, and provides feedback to the user that the action was performed. The provided feedback may be visual via the headset 705. In response, the engine 740 may perform one or more of the actions in the command and/or generate subsequent content to be provided to the headset 705 based on the commands.

Additional Configuration Information

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the disclosure may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. An audio assembly comprising:

an elongated body including an audio waveguide that has a first end and a second end opposite the first end;

a negative vent assembly coupled to the elongated body, the negative vent assembly including at least one negative vent that vents negative acoustic pressure waves generated by a back surface of a transducer coupled to the first end of the audio waveguide; and a positive vent assembly that is part of the elongated body and coupled to the second end of the audio waveguide, the positive vent assembly including at least one positive vent that vents positive acoustic pressure waves generated by a front surface of the transducer that is opposite the back surface.

2. The audio assembly of claim 1, wherein the elongated body has a first side and a second side opposite the first side, the first side oriented towards an ear of a user, and wherein the at least one positive vent of the positive vent assembly is on the first side of the elongated body.

3. The audio assembly of claim 2, wherein a positive vent of the positive vent assembly is a slit.

4. The audio assembly of claim 2, wherein the transducer comprises a diaphragm, the back surface of the transducer is a back surface of the diaphragm and the front surface of the transducer is a front surface of the diaphragm, and wherein the diaphragm is substantially parallel to the first side of the elongated body.

5. The audio assembly of claim 2, further comprising:

a cap removably coupled to the second side of the elongated body, the cap covering the second side of the elongated body when coupled to the second side of the elongated body; and a band removably coupled to the cap, the band configured to hold the audio assembly onto a head of the user.

6. The audio assembly of claim 1, wherein the elongated body has a twist such that the first end of the audio waveguide is rotated relative to the second end of the audio waveguide.

7. The audio assembly of claim 1, further comprising:

a back chamber coupled to the transducer on the back surface, wherein the negative vent of the negative vent assembly is located on the back chamber and vents the negative acoustic pressure waves from the back chamber.

8. The audio assembly of claim 7, further comprising:

one or more headset coupling elements located on the back chamber that removably couple the audio assembly to a headset.

9. The audio assembly of claim 1, wherein the positive vent assembly is configured to be closer to an ear of a user than the negative vent assembly.

10. The audio assembly of claim 1, wherein the audio waveguide comprises one or more supports located within the audio waveguide, wherein the supports provide structural support to the audio waveguide.

11. The audio assembly of claim 1, wherein the transducer comprises a diaphragm and a frame perpendicular to the diaphragm, the back surface of the transducer is a back surface of the diaphragm and the front surface of the transducer is a front surface of the diaphragm, the diaphragm coupled to a ledge of the frame.

12. An audio assembly comprising:

an elongated body including an audio waveguide that has a first end and a second end opposite the first end;

a transducer coupled to the elongated body at the first end of the audio waveguide and configured to generate positive acoustic pressure waves from a front surface of the transducer and negative acoustic pressure waves from a back surface of the transducer, the front surface opposite the back surface;

a negative vent assembly coupled to the transducer, the negative vent assembly including at least one negative vent that vents the negative acoustic pressure waves generated by the back surface of the transducer; and a positive vent assembly that is part of the elongated body and coupled to the second end of the audio waveguide, the positive vent assembly including at least one positive vent that vents the positive acoustic pressure waves.

13. The audio assembly of claim 12, wherein the elongated body has a first side and a second side opposite the first side, the first side oriented towards an ear of a user, and wherein the at least one positive vent of the positive vent assembly is on the first side of the elongated body.

14. The audio assembly of claim 13, wherein a positive vent of the positive vent assembly is a slit.

15. The audio assembly of claim 13, wherein the transducer comprises a diaphragm, the back surface of the transducer is a back surface of the diaphragm and the front surface of the transducer is a front surface of the diaphragm, and wherein the diaphragm is substantially parallel to the first side of the elongated body.

16. The audio assembly of claim 13, further comprising:

a cap removably coupled to the second side of the elongated body, the cap covering the second side of the elongated body when coupled to the second side of the elongated body; and a band removably coupled to the cap, the band configured to hold the audio assembly onto a head of the user.

17. The audio assembly of claim 12, further comprising:

a back chamber coupled to the transducer on the back surface, wherein the negative vent of the negative vent assembly is located on the back chamber and vents the negative acoustic pressure waves from the back chamber.

18. The audio assembly of claim 17, further comprising:

one or more headset coupling elements located on the back chamber that removably couple the audio assembly to a headset.

19. The audio assembly of claim 12, wherein the positive vent assembly is configured to be closer to an ear of a user than the negative vent assembly.

20. The audio assembly of claim 12, wherein the transducer comprises a diaphragm and a frame perpendicular to the diaphragm, the back surface of the transducer is a back surface of the diaphragm and the front surface of the transducer is a front surface of the diaphragm, the diaphragm coupled to a ledge of the frame.

* * * * *